US008215126B2

(12) United States Patent
Mattar

(10) Patent No.: US 8,215,126 B2
(45) Date of Patent: Jul. 10, 2012

(54) SETTING FOR GEMSTONES, PARTICULARLY DIAMONDS

(76) Inventor: Rany Mattar, Nazareth Ilit (IL)

( * ) Notice: Subject to any disclaimer, the term of this patent is extended or adjusted under 35 U.S.C. 154(b) by 375 days.

(21) Appl. No.: 11/712,478

(22) Filed: Mar. 1, 2007

(65) Prior Publication Data

US 2008/0209943 A1 Sep. 4, 2008

(51) Int. Cl.
*A44C 17/02* (2006.01)

(52) U.S. Cl. ..... 63/26; 63/27; 63/28

(58) Field of Classification Search ..... 63/26, 27, 63/28

See application file for complete search history.

(56) References Cited

U.S. PATENT DOCUMENTS

| | | | | | |
|---|---|---|---|---|---|
| 450,618 | A | * | 4/1891 | Hogg | 29/10 |
| 2,044,510 | A | * | 6/1936 | Reilly | 63/26 |
| 4,738,240 | A | | 4/1988 | Aich | |
| 5,044,177 | A | | 9/1991 | Favre | |
| 5,072,601 | A | | 12/1991 | Slowinski | |
| 5,115,649 | A | | 5/1992 | Amber | |
| 5,123,265 | A | * | 6/1992 | Ramot | 63/28 |
| 5,437,167 | A | | 8/1995 | Ambar | |
| 5,520,017 | A | | 5/1996 | Vivat | |
| 5,649,434 | A | | 7/1997 | Itzkowitz | |
| 5,713,219 | A | | 2/1998 | Itzkowitz | |
| 5,848,539 | A | | 12/1998 | Ouzounian | |
| 6,003,335 | A | | 12/1999 | Gurevich et al. | |
| 6,065,308 | A | * | 5/2000 | Piat et al. | 63/37 |
| 6,112,552 | A | * | 9/2000 | Hoffman | 63/26 |
| 6,293,129 | B1 | | 9/2001 | Gurevich | |
| 6,389,846 | B1 | | 5/2002 | Siebenberg | |
| 6,564,583 | B2 | | 5/2003 | Gruber | |
| 6,698,239 | B2 | | 3/2004 | Wueste | |
| 2003/0101747 | A1 | * | 6/2003 | Feldman | 63/26 |
| 2006/0272355 | A1 | * | 12/2006 | Heimann | 63/26 |
| 2008/0163647 | A1 | * | 7/2008 | Rosen | 63/28 |
| 2009/0100870 | A1 | | 4/2009 | Lai | |

FOREIGN PATENT DOCUMENTS

| | | |
|---|---|---|
| EP | 1068815 | 1/2001 |
| NL | 7109148 | 1/1973 |

OTHER PUBLICATIONS

Gemological Institute of America, "About the 4Cs: Cut". http://www.gia.edu/lab-reports-services/about-the-4cs/.*
Breguet: "Les collections Breguet", 4 P., Oct. 2007.
Office Action Dated Dec. 28, 2009 From the Israel Patent Office Re.: Application No. 188188.

(Continued)

*Primary Examiner* — Jack W Lavinder
*Assistant Examiner* — Emily Morgan

(57) ABSTRACT

A novel setting for a gemstone including a girdle, a crown on one side of the girdle, and a pavilion on the opposite side of the girdle, characterized in that the setting mounts the gemstone in an inverted orientation by prongs received in grooves formed in the crown of the gemstone such that the pavilion faces outwardly of the setting and the crown faces inwardly of the setting. Such a mounting is particularly useful when mounting a plurality of gemstones contiguously, in which case the prongs mounting each gemstone are concealed by the girdles of the gemstones. One embodiment is described wherein a plurality of gemstones are all mounted in the inverted orientation with the pavilions facing outwardly, and another embodiment is described wherein alternate gemstones are mounted in the inverted orientation with the pavilions facing outwardly, and with the remaining gemstone being mounted in the normal orientation with the crowns facing outwardly.

16 Claims, 7 Drawing Sheets

OTHER PUBLICATIONS

Response Dated Mar. 21, 2010 to Office Action of Dec. 28, 2009 From the Israel Patent Office Re.: Application No. 188188.
Breguet "Les Collections Breguet", Oct. 2007, 4 pages.
European Search Report and the European Search Opinion Dated Apr. 19, 2010 From the European Patent Office Re.: Application No. 07121132.0.
Response Dated Jul. 18, 2010 to Office Action of Apr. 15, 2010 From the Israel Patent Office Re.: Application No. 188188.
Communication Pursuant to Article 94(3) EPC Dated Jan. 27, 2011 From the European Patent Office Re.: Application No. 07121132.0.
Response Dated May 27, 2010 to European Search Report and the European Search Opinion of Apr. 19, 2010 From the European Patent Office Re.: Application No. 07121132.0.
Communication Pursuant to Article 94(3) EPC Dated Nov. 21, 2011 From the European Patent Office Re.: Application No. 07121132.0.
Response Dated Oct. 23, 2011 to Office Action of Dec. 14, 2010 From the Israel Patent Office Re.: Application No. 188188.
Diamond "Blue Nile Cut", Diamond Education, Retrieved From the Internet, Feb. 9, 2011.
GIA "Diamond Grading Report", GIA, Gemological Institute of America, 1 P., Jan. 1, 2006.
Green et al. "Diamond Optics Part 1: Reflection, Refraction and Critical Angle", GIA, Gemological Institute of America, 4 P., Jul. 6, 2001.
Green et al. "Diamond Optics Part 2: Light Dispersion, Color Wavelengths and Fire", GIA, Gemological Institute of America, 6 P., Jul. 20, 2001.
Green et al. "Diamond Optics Part 3: The Effects of Polarization States on Light Behavior", GIA, Gemological Institute of America, 4 P., Aug. 3, 2001.
Response Dated Feb. 10, 2011 to Communication Pursuant to Article 94(3) EPC of Jan. 27, 2011 From the European Patent Office Re.: Application No. 07121132.0.
Office Action Dated Dec. 14, 2010 From the Israel Patent Office Re.: Application No. 188188 and Its Translation Into English.
Gefen "Special Diamond Cuts: GNN's Emerella Design Uses Technology to Create More Diamond Value for Less", Israeli Diamond News Center, Retrieved From the Internet, Feb. 2, 2006.
Gefen "Special Diamond Cuts: SKR Merges Technology and Craftsmanship to Create Alito Brand", Israeli Diamond News Center, Retrieved From the Internet, Jul. 7, 2005.
Suermann "Invisible Setting. Labor-Intensive Craft Creates the Illusion of a Vanished Setting", Professional Jeweler Magazine Archives, PJM, Retrieved From the Internet, Apr. 2000.
Weldon "Greater Than the Sum of Its Parts", Professional Jeweler Magazine Archives, PJM, Retrieved From the Internet, Oct. 2002.

* cited by examiner

SETTING FOR GEMSTONES, PARTICULARLY DIAMONDS

FIELD AND BACKGROUND OF THE INVENTION

The present invention relates to new settings for gemstones, particularly diamonds, and also to jewelry pieces including such settings.

Diamonds and other gemstones are frequently mounted in various ways to produce different optical impressions and different optical effects. For example, one popular type of mounting includes an invisible setting, namely a setting which is not visible from the outer face of the gemstone. Invisible settings are particularly used when a plurality of such gemstones are mounted contiguously to each other so as to create the appearance of a single large gemstone. Many invisible settings have been devised for this purpose. The typical invisible settings in use today generally include prongs or the like received in grooves or notches formed in the pavilion of each gemstone so as to mount the gemstone with the crown facing outwardly, with the pavilion facing inwardly, and with the prongs concealed by the girdle.

OBJECTS AND BRIEF SUMMARY OF THE PRESENT INVENTION

An object of the present invention is to provide a novel setting for gemstones, particularly for diamonds, which produces a novel optical appearance and which is particularly useful in an invisible setting.

According to a broad aspect of the present invention, there is provided an invisible setting for a gemstone including a girdle, a crown on one side of the girdle and normally oriented to face outwardly of the setting, and a tapered pavilion on the opposite side of the girdle of larger height than the crown and normally oriented to face inwardly of the setting; characterized in that the invisible setting mounts the gemstone in an inverted orientation with the pavilion facing outwardly of the setting and with the crown facing inwardly of the setting.

In the described preferred embodiments, the invisible setting includes prongs received in grooves formed in the crown of the gemstone and concealed by the girdle.

It will thus be seen that the novel setting as defined above mounts the gemstone in an inverse orientation with respect to the way the gemstone is normally mounted in a conventional setting. Such a setting produces a novel effect particularly when used for mounting a plurality of gemstones contiguously to each other.

Thus, according to another aspect of the present invention, there is provided a novel setting for a plurality of gemstones mounted contiguously to each other, each gemstone including a girdle, a crown on one side of the girdle, and a pavilion on the opposite side of the girdle; characterized in that the setting for at least some of the gemstones mounts the respective gemstone in an inverted orientation with the pavilion facing outwardly of the setting and with the crown facing inwardly of the setting. In the described preferred embodiment, the setting mounts all the gemstones such that the setting is concealed by the girdles of the gemstones, thereby producing an invisible setting creating the impression of a single large gemstone, rather than a plurality of gemstones.

In one described preferred embodiment, all the gemstones are mounted in the inverse orientation, with the pavilions facing outwardly of the setting, with the crowns facing inwardly of the setting, and with the setting concealed by the girdles. Described below are one arrangement wherein all the gemstones are mounted in a single row, and another arrangement wherein all the gemstones are mounted in a plurality of rows.

According to another described preferred embodiment, alternate gemstones are mounted in the inverse orientation with the pavilions facing outwardly, the crowns facing inwardly, and the prongs concealed by the girdles; whereas the remaining alternate gemstones are mounted in the normal orientation, with the crowns facing outwardly, the pavilions facing inwardly, and the prongs concealed by the girdles. Also in this arrangement, the gemstones may be mounted in a single row or in a plurality of rows.

In the above-described arrangements, the pavilions, in the inversely-oriented gemstones, may be blunted or formed with the normal culet.

For purposes of example, the invisible setting is described below with respect to a ring, but it will be appreciated that it could also be used in pendants, bracelets. or other articles of jewelry.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

THE PRIOR ART

Figure 1:
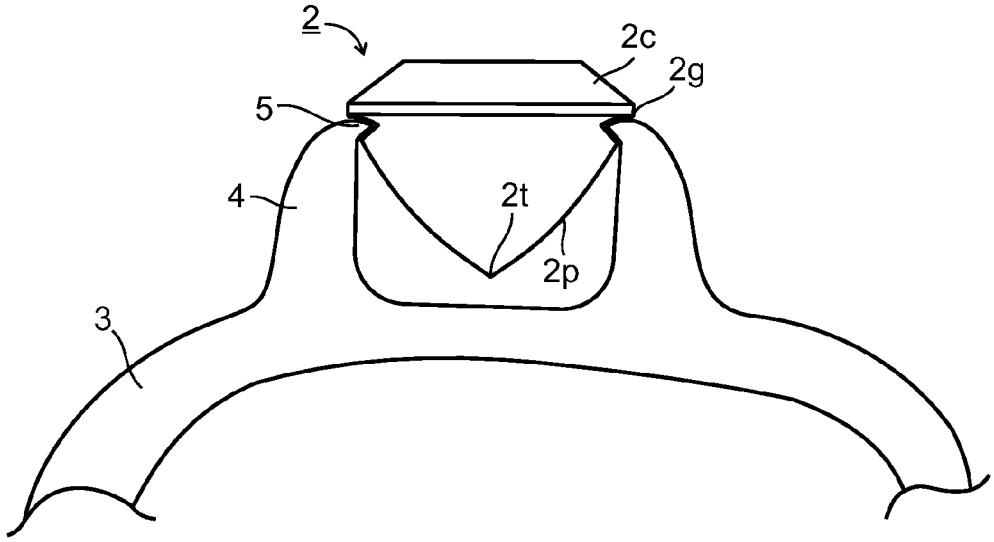
FIG. 1 (PRIOR ART)
FIG. 1 illustrates a conventional prior art invisible setting for a single gemstone.

FIG. 1 illustrates a typical prior art setting for a diamond, generally designated 2. For purposes of example, diamond 2 is of the brilliant cut, including a girdle 2*g*, a crown 2*c* on one side of the girdle, and a pavilion 2*p* on the opposite side of the girdle. The girdle is generally defined as the portion of the diamond of largest cross-sectional area. The crown 2*c* tapers inwardly and generally terminates in a flat table. The pavilion 2*p*, of greater height than the crown, also tapers inwardly and terminates in a cutlet 2*t*. Both the crown 2*c* and the pavilion 2*p* are generally faceted according to the particular cut involved.

For purposes of example, FIG. 1 illustrates the diamond 2 as being mounted in a ring 3 by a conventional invisible setting 4. Such a setting includes a plurality of prongs 5 received within grooves or notches formed in the pavilion 2*p* of the diamond just below the girdle 2*g*. As shown in FIG. 1, in such a conventional invisible setting, the diamond is oriented such that the crown 2*c* faces outwardly, and the pavilion 2*p* faces inwardly.

Figure 2:
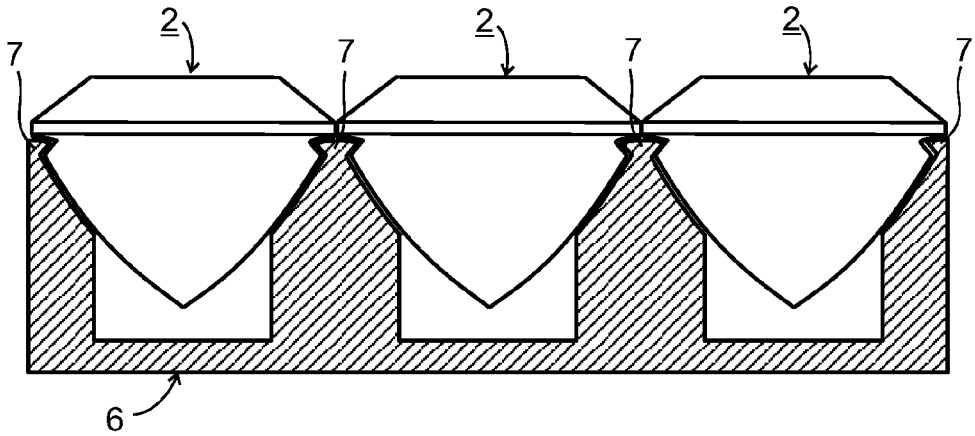
FIG. 2 (PRIOR ART)
FIG. 2 illustrates a conventional prior art invisible setting for a plurality of gemstones.

Invisible settings are frequently used for mounting a plurality of diamonds contiguously to each other, as shown in FIG. 2, in order to create the appearance of a single large diamond. A typical invisible setting for a plurality of diamonds is illustrated in FIG. 2. In such invisible settings, the mounting, designated 6, is such that the girdles of the diamonds conceal the prongs of the mounting, shown at 7 in FIG. 2, to thereby create the appearance of a single large diamond, rather than a plurality of smaller diamonds. Such invisible settings for a plurality of diamonds are frequently used not only with respect to rings, but also with respect to pendants, bracelets and other jewelry articles.

DESCRIPTION OF PREFERRED EMBODIMENTS OF THE PRESENT INVENTION

Figure 3:
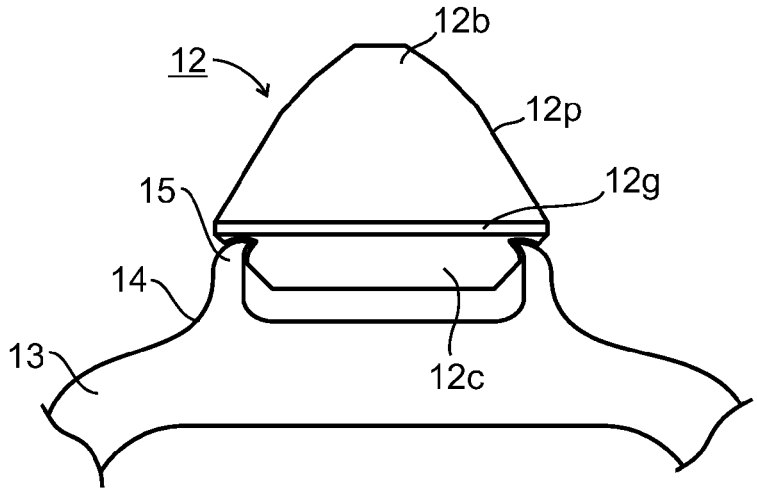
FIG. 3 illustrates an invisible setting for a single gemstone in accordance with the present invention.
Figure 4:
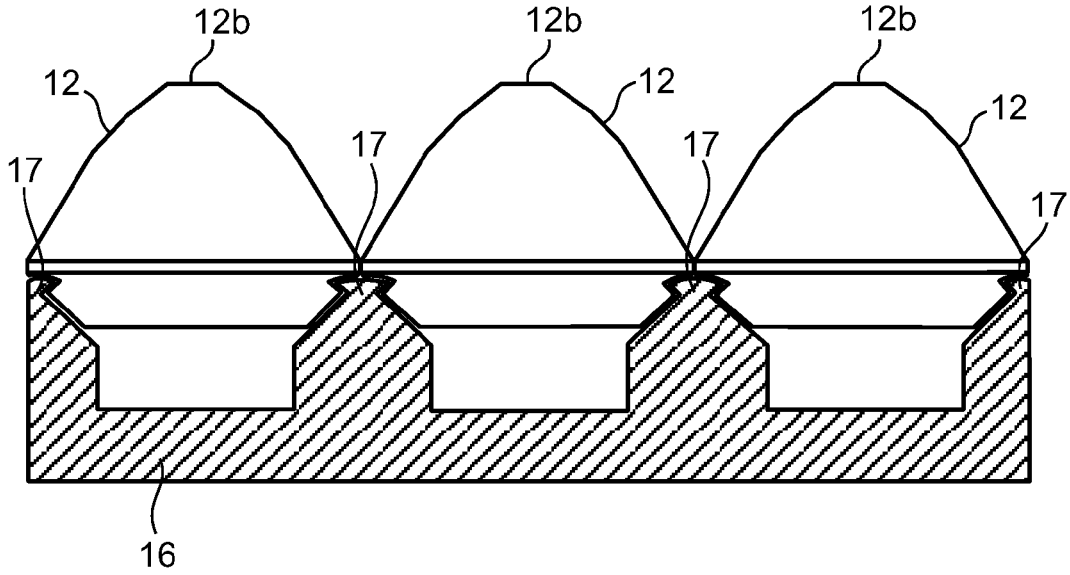
FIG. 4 illustrates an invisible setting for a row of gemstones in accordance with the present invention.

FIGS. 3 and 4 are views, corresponding to FIGS. 1 and 2, but illustrating the novel mounting producing an invisible setting for a single diamond (FIG. 3), or a plurality of diamonds (FIG. 4), in accordance with the present invention.

In FIG. 3 illustrating a diamond 12 mounted in a ring 13 by an invisible setting 14, it will be seen that the diamond 12 is mounted in an inverse orientation to the conventional setting arrangement of FIG. 1, namely with the pavilion 12*p* facing outwardly, and the crown 12*c* facing inwardly. For this purpose, the crown 12*c* is formed with the grooves or notches for receiving the prongs 15, with the prongs being concealed by the girdle 12*g*. In such a mounting, the tip of the pavilion 12*p* is preferably blunted, as shown at 12*b*.

FIG. 4 illustrates how a plurality of diamonds 12 may be mounted as described above with respect to FIG. 3 contiguously to each other in a common mounting 16, with the prongs 17 concealed by the girdles of the diamonds so as to create the appearance of a single large diamond, rather than a plurality of smaller diamonds.

Figure 5:
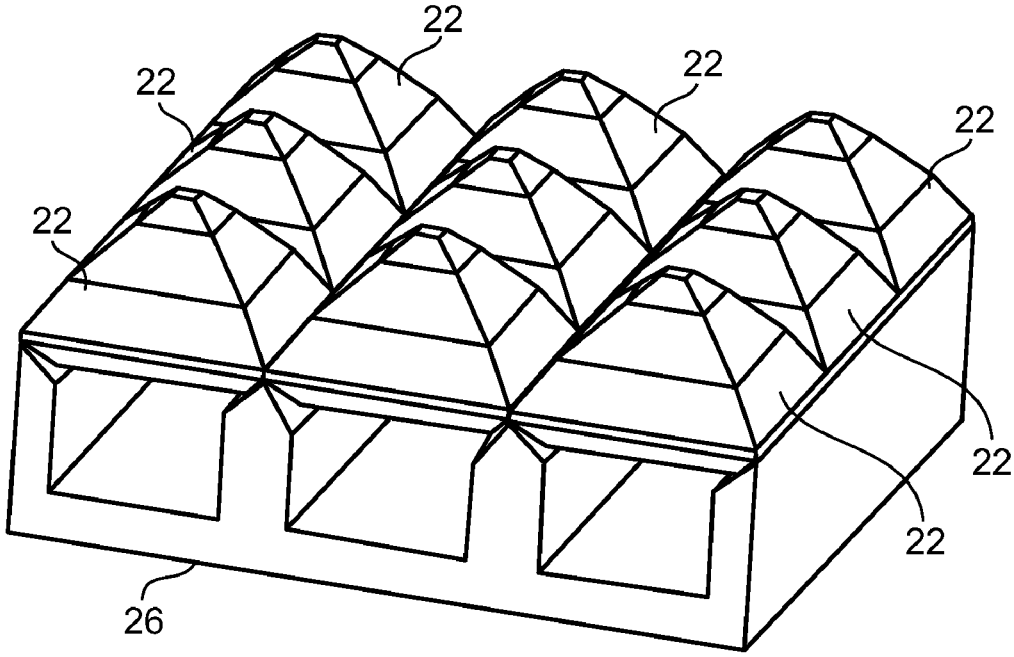
FIG. 5 illustrates an invisible setting arrangement for mounting a plurality of gemstones according to FIG. 4 in a plurality of rows.

FIG. 4 illustrates a single row of diamonds 12 so mounted, whereas FIG. 5 diagrammatically illustrates how a plurality of rows of diamonds 22 can be so mounted, to create the appearance of a single large diamond. In FIGS. 4 and 5, all the diamonds are mounted in an inverse orientation manner as described above with respect to FIG. 3, i.e., with the pavilions facing outwardly and the crowns facing inwardly.

Figure 6:
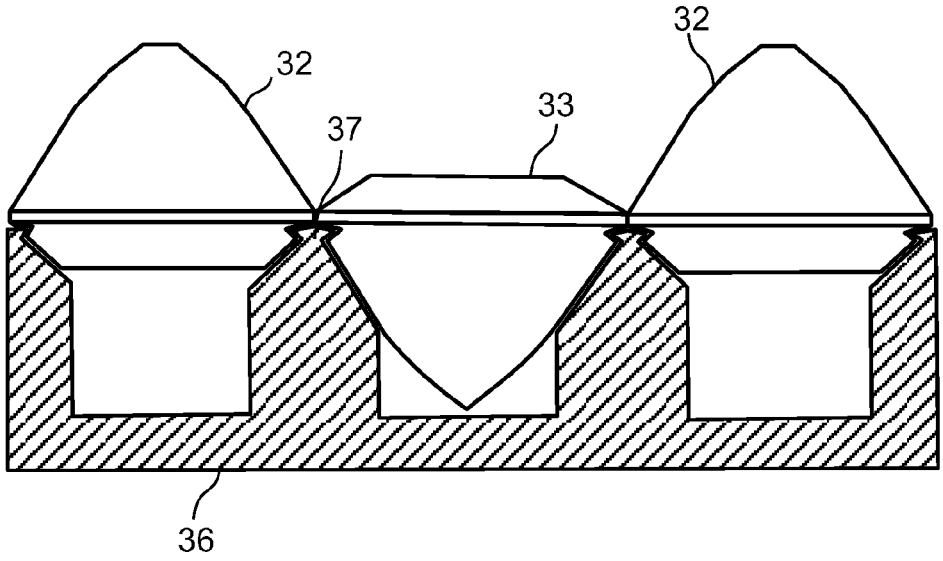
FIGS. 6 and 7 are views, corresponding to FIGS. 4 and 5, respectively, illustrating another invisible setting arrangement for mounting a plurality of gemstones in accordance with the present invention.
Figure 7:
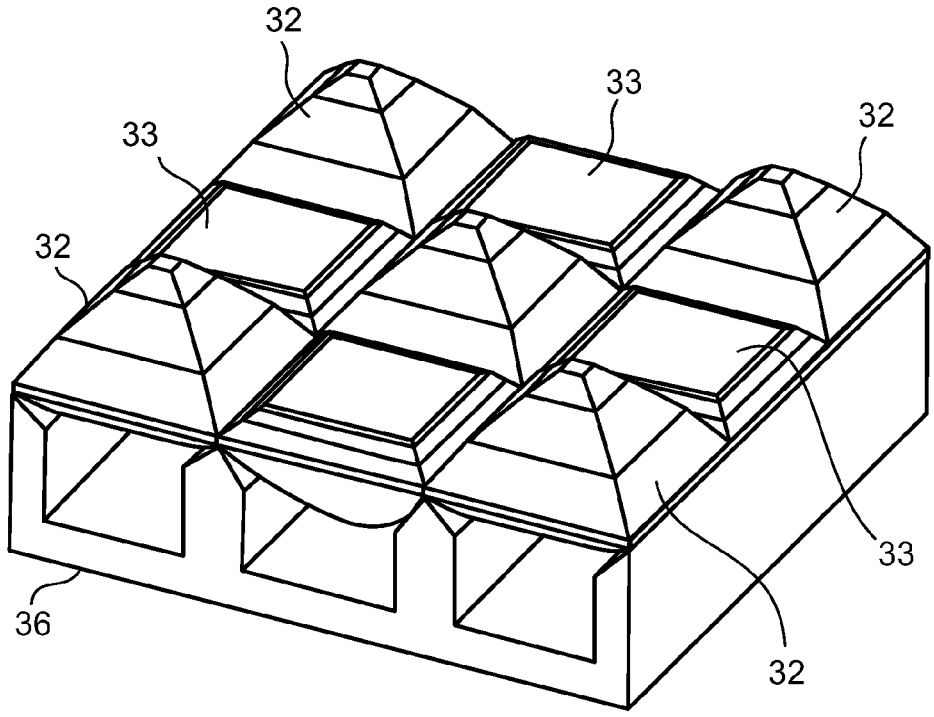

FIGS. 6 and 7 are views, corresponding to those of FIGS. 4 and 5, but showing another arrangement which may be used, namely wherein alternate diamonds 32 are mounted by invisible settings in an inverse orientation in a common mounting 36, as described above, with the pavilions facing outwardly; whereas the remaining alternate diamonds 33 are mounted in a conventional orientation as illustrated in FIGS. 1 and 2 with the crowns facing outwardly and the pavilions facing inwardly.

Figure 8:
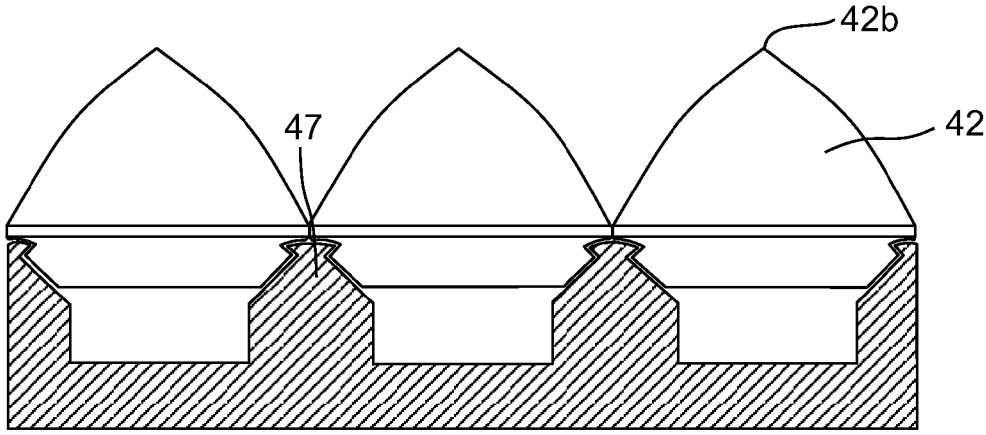
FIGS. 8, 9 and 10 illustrate settings corresponding to those of FIGS. 4, 5 and 7, respectively, but with the outer tip of the outwardly-facing pavilions, in the reversely-oriented gemstones, being formed with conventional culets, rather than being blunted.
Figure 9:
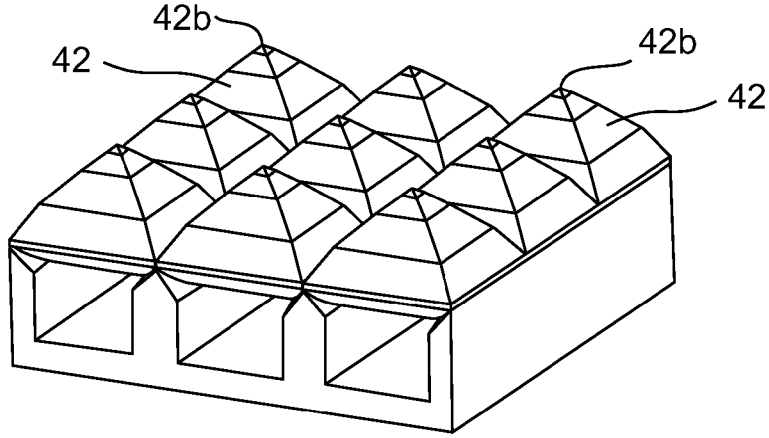
Figure 10:
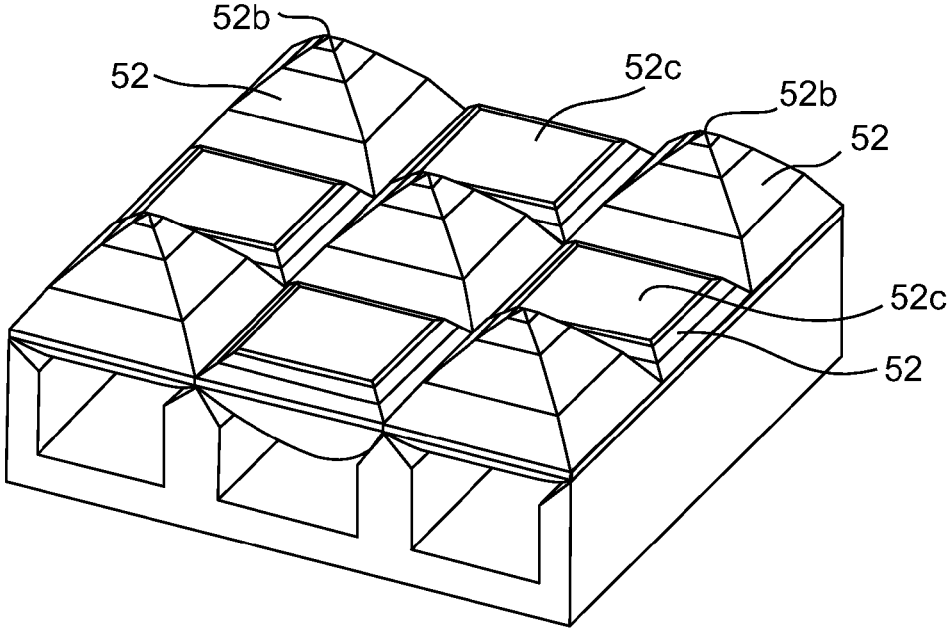

In the settings illustrated in FIGS. 3-7, the inversely-oriented gemstones, namely those with the pavilions facing outwardly (rather than inwardly), terminate in blunted tips, rather than in culets. It will be appreciated, however, that the pavilions in such inversely-oriented gemstones may also terminate in conventional culets, and this is shown for example in FIGS. 8-10, illustrating settings similar to those of FIGS. 4-7, respectively, but with conventional culets rather than blunted tips. Thus, FIGS. 8 and 9 illustrate an arrangement similar to that of FIG. 5, but with the tips of the pavilions 42 terminating in pointed culets 42*b* facing outwardly; and FIG. 10 illustrates an arrangement similar to that FIGS. 6 and 7, wherein alternate diamonds 52 are reversely mounted with their culets 52*b* facing outwardly and the other diamonds are mounted in the conventional manner with the tables 52*c* facing outwardly.

Figure 11:
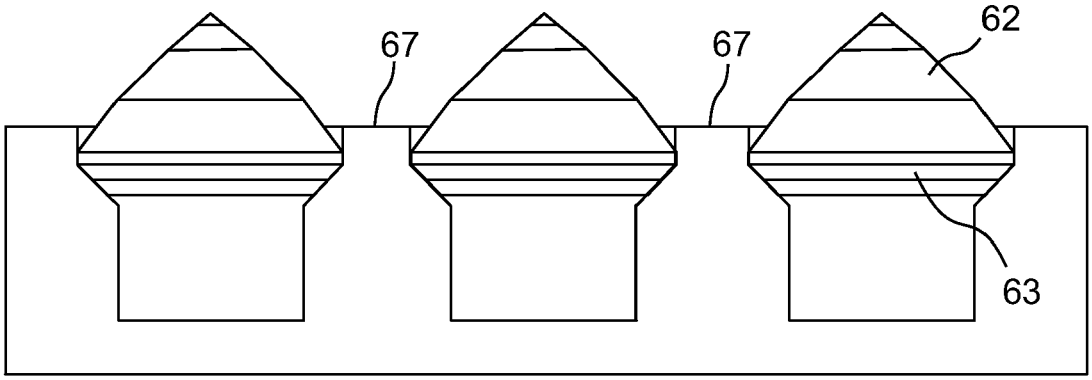
FIGS. 11 and 12 illustrate conventional (i.e., not non-visible) settings for reversely-oriented gemstones mounted in accordance with the present invention.
Figure 12:
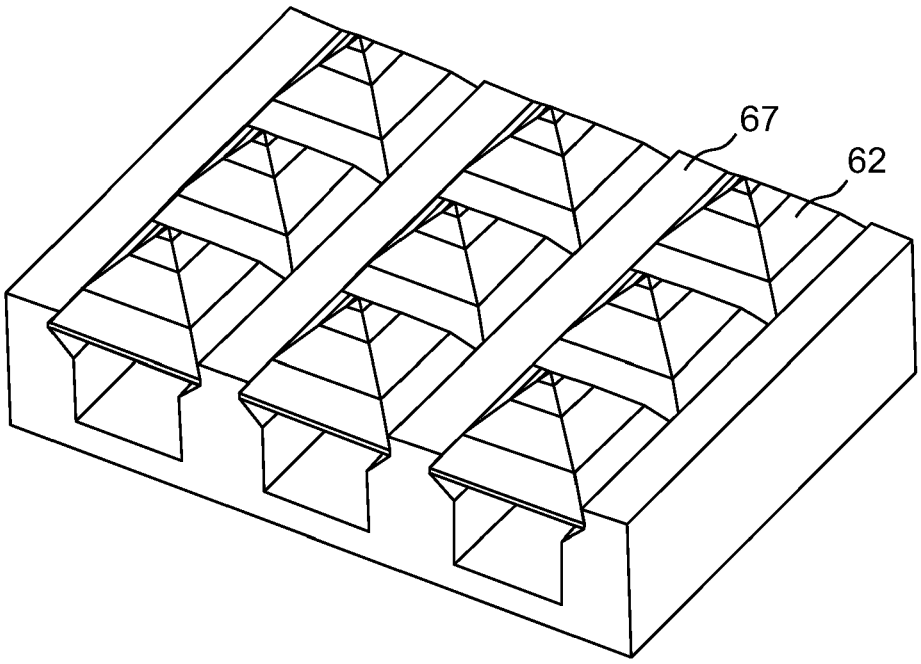

For purposes of example, FIGS. 11 and 12 illustrate reversely-oriented gemstones mounted in accordance with the present invention in conventional settings, e.g., visible settings. Thus, FIGS. 11 and 12 illustrate all the diamonds reversely mounted with their pavilions 62 facing outwardly, but with their settings 67 engaging grooves formed in the Settings 67, rather than in the crowns 63 of the gemstones, so that the settings 67 are visible.

It will be appreciated that the novel invisible setting as described above, and as illustrated particularly in FIGS. 3-10, could be used with respect to other types of gemstone, other types of jewelry, and other types gemstone cuts.

Figure 13:
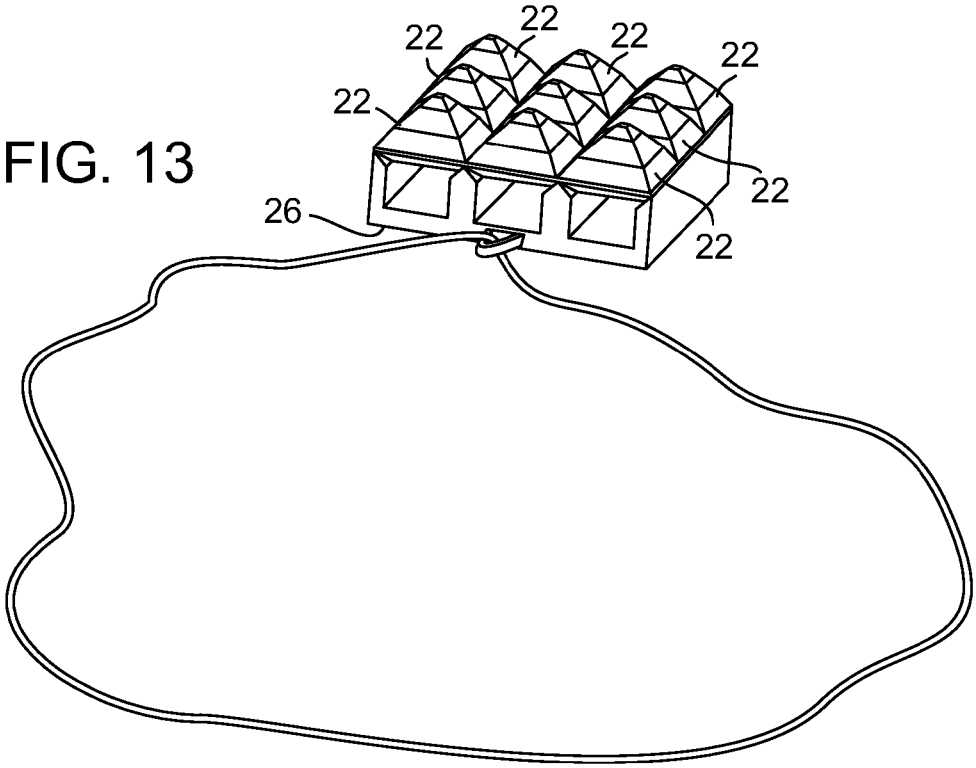
FIGS. 13 and 14 illustrate the use of the array of FIG. 5 in exemplary items of jewelry according to embodiments of the present invention.
Figure 14:
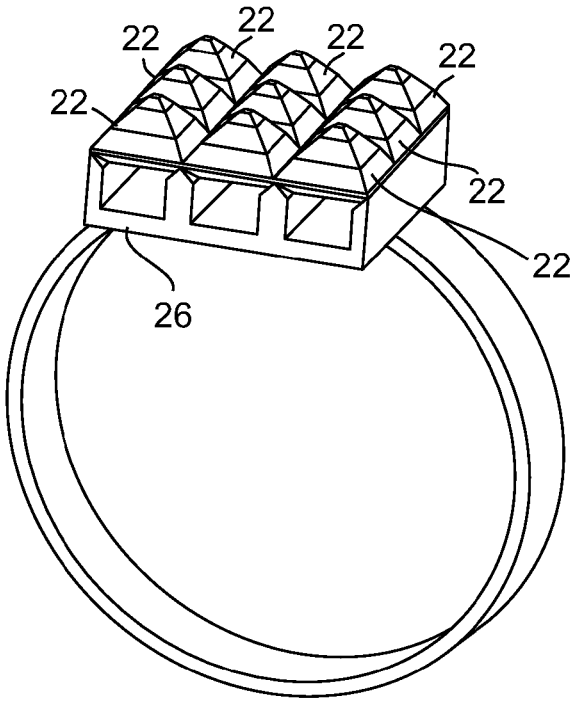

For example, FIG. 13 illustrates the use of the array of FIG. 5 in a pendant. FIG. 14 illustrates the use of the array of FIG. 5 in a ring.

Many other variations, modifications and applications of the invention will be apparent.

What is claimed is:

1. An item of jewelry comprising a plurality of faceted rectangular diamonds mounted contiguously to each other, each diamond including a girdle, a crown on one side of the girdle, and a pavilion on the opposite side of the girdle; characterized in that a setting for at least a two by two array of said diamonds mounts the respective diamond in an inverted orientation with the pavilion facing outwardly of the setting and with the crown facing inwardly of the setting, said rectangular diamonds are contiguously mounted in said array in said inverted orientation, wherein the setting of each diamond mounted in said array includes means for mounting received in grooves or notches formed in the crown of the respective diamond.

2. The item of jewelry according to claim 1, wherein the setting mounts all the diamonds such that the setting is concealed by the girdles of the diamonds.

3. The item of jewelry according to claim 1, wherein the tip of the pavilion of each diamond mounted in said inverted orientation is blunted.

4. The item of jewelry according to claim 1, wherein the tip of the pavilion of each diamond facing outwardly terminates in a cutlet.

5. The item of jewelry according to claim 1, wherein the means for mounting received in grooves or notches formed in the crown of the respective diamond are concealed by the girdle of the respective diamond.

6. The item of jewelry according to claim 1, wherein the item is a ring.

7. The item of jewelry according to claim 1, wherein the item is a pendant.

8. An item of jewelry according to claim 1 wherein said means for mounting are concealed from view by the diamonds.

9. An item of jewelry according to claim 1, wherein said diamonds comprise a three by three array of diamonds in said inverted orientation.

10. An item of jewelry according to claim 1, wherein said rectangular diamonds are square diamonds.

11. An item of jewelry according to claim 1, wherein said means for mounting are prongs.

12. A method of producing an item of jewelry according to claim 1, the method comprising:

providing a setting for an at least two by two contiguous array of diamonds; and mounting faceted rectangular diamonds in the setting, such that the diamonds are mounted in an inverted orientation, with the pavilion of the diamonds facing outwardly of the setting and with the crown of the diamonds facing inwardly of the setting.

13. A method to claim 12, wherein mounting faceted rectangular diamonds in the setting further comprises mounting such that the setting is concealed by the girdles of the diamonds.

14. A method according to claim 12, wherein mounting faceted rectangular diamonds in the setting further comprises receiving means for mounting grooves or notches formed in the crown of the respective diamond.

15. A method according to claim 12, wherein providing a setting for an at least two by two contiguous array of diamonds comprises providing a setting for an at least three by three contiguous array of diamonds.

16. A method according to claim 12, wherein mounting faceted rectangular diamonds in the setting further comprises mounting square diamonds.

* * * * *